United States Patent [19]

Abendroth

[11] Patent Number: 4,703,601

[45] **Date of Patent: * Nov. 3, 1987**

[54] FASTENER FOR FLOORING SYSTEMS

[76] Inventor: Carl W. Abendroth, 210 Crystal Ave., Crystal Falls, Mich. 49920

[ * ] Notice: The portion of the term of this patent subsequent to Oct. 14, 2003 has been disclaimed.

[21] Appl. No.: 856,015

[22] Filed: Apr. 25, 1986

Related U.S. Application Data

[63] Continuation-in-part of Ser. No. 656,699, Oct. 1, 1984, Pat. No. 4,616,462.

[51] Int. Cl.[4] ..... E04C 1/40; E04B 2/04

[52] U.S. Cl. ..... 52/509; 52/512; 52/714; 52/779

[58] Field of Search ..... 52/509, 512, 489, 586, 52/763, 779, 714

[56] References Cited

U.S. PATENT DOCUMENTS

| | | | |
|---|---|---|---|
| 1,888,611 | 11/1932 | Wolfson | 52/512 |
| 1,889,138 | 11/1932 | Wolfson | 52/512 |
| 1,988,147 | 1/1935 | Voigt | 52/488 |
| 2,317,428 | 4/1943 | Anderson | 52/714 X |
| 2,817,125 | 12/1957 | Johns | 52/512 |
| 2,831,222 | 4/1958 | Anderson | 52/512 X |
| 3,266,209 | 8/1966 | Zibell | 52/489 X |
| 3,641,720 | 2/1972 | Berrie | 52/586 X |

FOREIGN PATENT DOCUMENTS

| | | | |
|---|---|---|---|
| 403261 | 12/1933 | United Kingdom | 52/512 |
| 697546 | 9/1953 | United Kingdom | 52/489 |

*Primary Examiner*—Alfred C. Perham

*Attorney, Agent, or Firm*—Michael, Best & Friedrich

[57] ABSTRACT

A flooring system comprising a foundation, a plurality of adjacent floorboards, each of the floorboards including a generally vertical side including a generally horizontal slot, and a base adjacent the foundation and including therein an opening spaced from the side, and clips for fastening the floorboards to the foundation, each including a generally horizontal upper portion received in the slot in the floorboard, a generally vertical portion, a lower generally horizontal base portion extending between the foundation and the base of the floorboard, and a projection extending upwardly in the base portion and spaced from the vertical portion and received in the opening in the base of the floorboard.

17 Claims, 8 Drawing Figures

FASTENER FOR FLOORING SYSTEMS

BACKGROUND OF THE INVENTION

This is a continuation-in-part of now abandoned U.S. application Ser. No. 656,699, now U.S. Pat. No. 4,616,462, issued Oct. 1, 1984.

This invention relates to flooring systems and, more particularly, to flooring systems including means interacting between a fastener and floorboards for effecting positive engagement between the floorboards and the fastener.

Attention is directed to Wolfson U.S. Pat. No. 1,889,138, issued Nov. 29, 1932, which discloses a T-shaped fastener for a flooring system, and Wolfson U.S. Pat. No. 1,888,611, issued Nov. 22, 1932, which discloses a T-shaped fastener for a flooring system, which fastener includes a base portion including a bend forming a hump in the base portion. As noted on page 2 of the '611 patent, lines 16 through 21 and lines 65 through 69, the hump in the base portion is flattened when the fastener is secured to the floor foundation. Attention is also directed to Anderson U.S. Pat. No. 2,831,222, issued Apr. 22, 1958, which patent discloses fastening means including a horizontal portion including a bend forming a hump therein.

SUMMARY OF THE INVENTION

This invention provides a flooring system comprising a foundation, a plurality of adjacent floorboards, each of the floorboards including a generally vertical side including a generally horizontal slot, and a base adjacent the foundation and including therein an opening spaced from the side, and a plurality of clips, each including a generally horizontal upper portion received in the slot in the floorboard, a generally vertical portion, a lower generally horizontal base portion extending between the foundation and the base of the floorboard, and a projection extending outwardly on the base portion and received in the opening in the floorboard.

In one embodiment, each of the clips further includes means for fastening the clip to the foundation and comprising a fastener in the base portion of the clip, and the fastener includes a head projecting above the base portion of the clip and constituting the projection.

In one embodiment, the projection constitutes a bend in the base portion of the clip, which bend forms a vertically projecting hump which also extends generally parallel to the vertical portion of the clip. And the opening in the floorboard base comprises a groove extending generally parallel to the generally vertical side of the floorboard.

One of the principal features of the invention is the provision of a flooring system which includes floorboards and means for fastening the floorboards to the foundation, which means provides for positive engagement between the fastening means and the floorboards to help secure the floorboards in their proper positions.

Another of the principal features of the invention is the provision of means for fastening floorboards to a foundation, which means assists in the location of means for connecting the fastening means to the foundation.

Another of the principal features of the invention is the provision of such a flooring system which can be used to provide for little elevational gain or which can be used with a variety of underlayments.

The invention also provides a clip for securing a grooved floorboard to a substantially Planar sub-floor foundation, the clip comprising an elongate member of substantially T-shaped cross section including an upper portion receivable in the groove in the floorboard for indexing the floorboard relative to the elongate member, a base portion adjoining the elongate member in substantially perpendicular orientation relative to the sub-floor foundation, and a protuberance on the upper portion for engaging the floorboard along the groove to substantially retain the floorboard against sliding movement relative to the elongate member.

In one embodiment, the upper portion includes an edge, which is received in the groove in the floorboard, and a plurality of depressions formed in the edge to form the protuberances in the upper portion.

Other features and advantages of the invention will become apparent upon review of the detailed description, the drawings and the appended claims.

Figure 2:
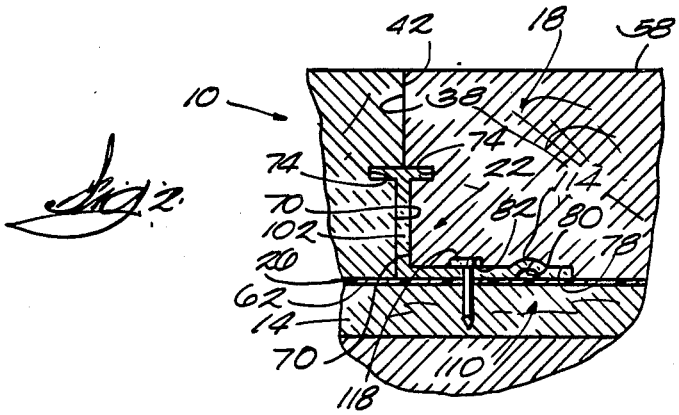
FIG. 2 is a cross-sectional view of the flooring system taken along the line 2—2 in FIG. 1.

Before explaining at least one embodiment of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

Figure 1:
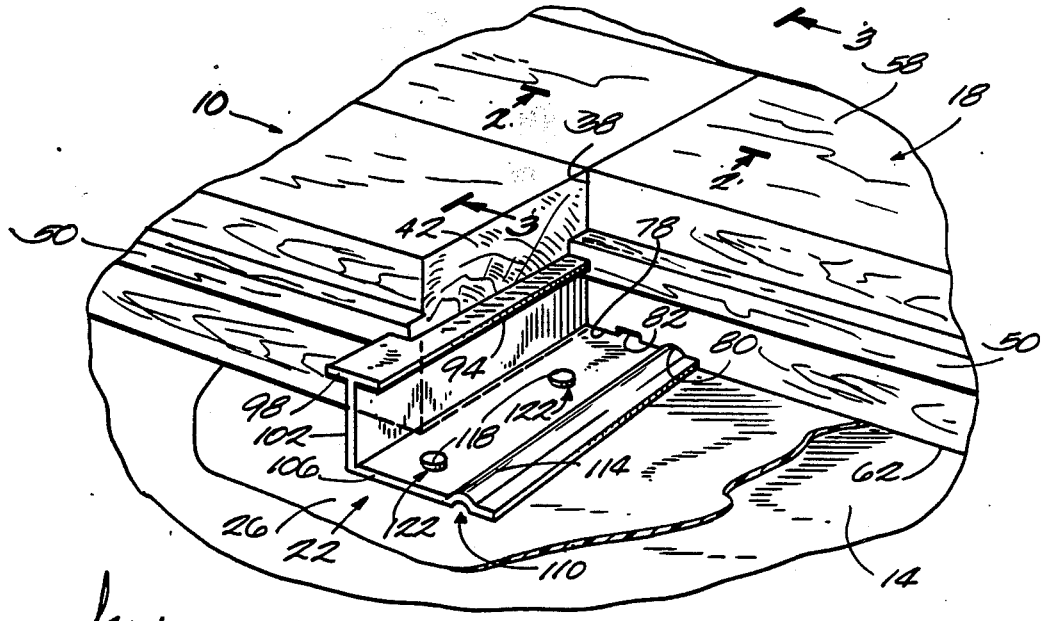
FIG. 1 is a partial perspective view of a portion of a flooring system which embodies various of the features of the invention.

With particular reference to the drawings, and more particularly to FIG. 1, a flooring system 10 is illustrated including a foundation or slab 14, a plurality of adjacent floorboards 18, and means 22 for fastening the floorboards 18 to the foundation 14.

The foundation 14 is a concrete subfloor which has been finished and leveled. Placed on top of the leveled slab is a vapor barrier 26 preferably made of six mil polyethylene with four inch lap joints covered with a felt membrane. In other embodiments, the foundation 14 can be an existing synthetic floor. Other types of vapor barriers 26 may also be used, such as two-ply asphalt saturated felt set in mastic.

The vapor barrier 26 may be overlayed with an underlayment (not shown) for cushioning and sound control, such as cork, compressed fill, or some other resilient material.

Although different materials of various sizes can be used, in this embodiment, the floorboards 18 are in the form of 25/32nds by 1½ inch hard maple flooring, with a uniform length of about twelve inches. The floorboards 18 are laid in end abutting courses of side-by-side floorboards 18 parallel with the long dimension of a room. Each of the floorboards 18 includes two spaced-apart generally vertical first and second sides 30 and 34, respectively (see FIG. 3), a front side or end 38 (see FIGS. 1 and 2), a rear side or end 42, and means 46 (see FIG. 3) for interlocking the adjacent first and second sides, 30 and 34, respectively, of different floorboards 38, said interlocking means 46 comprising a tongue 50 on the first side 30, and a groove 54 on the second side 34.

Each of the floorboards 18 also includes a top surface 58 and a bottom surface or base 62 which is laid adjacent the vapor barrier 26 on the foundation 14.

Figure 3:
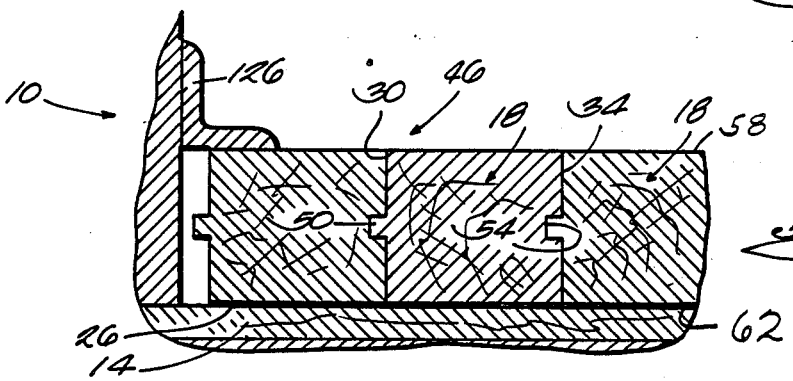
FIG. 3 is a cross-sectional view of the flooring system taken along the line 3—3 in FIG. 1.

As best illustrated in FIG. 2, each of the floorboards 18 also includes means for receiving the means 22 for fastening the floorboards 18 to the foundation 14, which receiving means comprises a generally vertical cutout 70, and a generally horizontal slot 74, which cutout 70 and slot 74 are in each of the front and rear ends 38 and 42, respectively. In other embodiments, the vertical cutout 70 can be in only one of the front and rear ends.

The means for receiving the fastening means 22 further includes, in the base 62 of the floorboards 18, a cutout 78, a first opening or groove 82 spaced from and extending generally parallel to the front end 38 of the floorboards 18, and a second opening or groove or recess 80 spaced from and extending generally parallel to the first groove 82 and the front end 38 of the floorboards 18.

As illustrated in FIGS. 1 and 2, the means 22 for fastening the floorboards 18 to the foundation 14 is in the form of a plurality of clips, with each of the clips 22 including a first generally horizontal upper portion 94 (see FIG. 1) received in the slot 74 in the front end 38 of the floorboards 18, a second generally horizontal upper portion 98 received in the slot 74 in the rear end 42 of the floorboards 18, a generally vertical portion 102 received in the cutouts 70, and a lower generally horizontal base portion 106 received in the cutout 78. In the particular embodiment shown, the first and second upper portions 94 and 98, respectively, are the same plane, and the clips 22 are fabricated from flexible sixteen guage steel.

The clips 22 for fastening the floorboards 18 to the foundation 14 also include means 110 for effecting a positive engagement between each of the floorboards 18 and each of the clips 22. The means 110 is in the form of upwardly extending projection means connected to the base portion 106, spaced from the vertical portion 102, and received in the first and second grooves 80 and 82, respectively, in the base 62 of the floorboards 18. More particularly, in this embodiment, the projection means comprises two projections 114 and 118. The projection 114 is in the form of a bend in the base portion 106 of the clips 22, which bend forms a hump in the base portion 106 extending generally parallel to the vertical portion 102 of the clips 22. The hump 114 is received in the first groove 80 in the base 62 of the floorboards 18. The other projection 118 is provided by fasteners 122 for fastening the clips 22 to the foundation 14, which fasteners 122, in this particular embodiment, are in the form of nails driven into the base portion 106 of the clips 22 at regular intervals less than the width of the ends of the floorboards 18. Each nail 122 has a head which projects above the base portion 106 of the clips 22, and which serves as the second projection 118. The head 118 is received in the second groove 82 in the base 62 of the floorboards 18. The nails 122, hump 114, first and second grooves 80 and 82, respectively, cutouts 70 in the front and rear ends 38 and 42, respectively, and the base cutout 78, are located so that, when the floorboards 18 are received by the clips 22, the front and rear ends 38 and 42, respectively, of the floorboards 18, are flush with one another.

The hump 114 also acts as a stop which can be used with a spacer (not shown), such as the muzzle of a nail gun, for locating the nails 122 near the midpoint between the generally vertical portion 102 of the clips 22 and the outer edge of the base portion 106 of the clips 22. The bend or hump 114 also serves to add longitudinal strength to the clips 122 when the clips 22 are fabricated and when the clips 22 are fastened to the foundation 14.

After a course of parallel floorboards 18 is laid across a room, the clips 22 are laid end to end and the second generally horizontal upper portions 98 of the clips 22 are received in the slot 74 in the rear end 42 of the floorboards 18. The clips 22 are then fastened to the foundation 14 by the nails 122 spaced at regular intervals along the clips 22. The next course of parallel floorboards 18 is attached to the clips 22 one floorboard at a time by having the front end 38 of each floorboard slipped over the first upper portion 94 of the clip 22 and between the upper portion 94 and the base portion 106. When this is done, the clip 22 is slightly flexed so each floorboard 18 can be inserted into the clip 22 to the point where the nail heads 118 and hump 114 are received in the first and second grooves 82 and 86, respectively. Since the nail heads 118 and hump 114 are located to register with the first and second grooves 82 and 86, respectively, at the Point where the front ends 38 and rear ends 42 come in contact, flush positioning of the courses of floorboards 18 is assured. Further, each of the following floorboards 18 to be laid can be connected to the clips 22 at a point spaced from the last floorboard, and then moved along the clips 22 to where the first side 30 of the floorboard is flush with the second side 34 of the prior floorboard.

After all of the courses of floorboards 18 are laid, the flooring system 10 may then be finished by attaching moldings 126 to the perimeter of the floorboards 18 to cover any perimeter voids.

Figure 4:
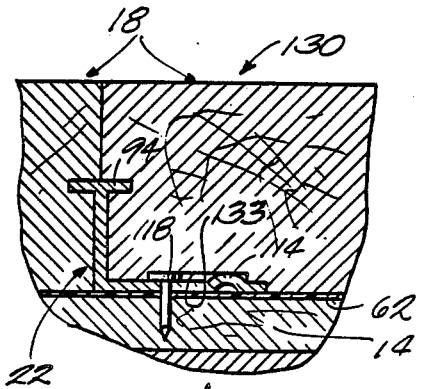
FIG. 4 is a cross-sectional view, similar to FIG. 2, of another flooring system which embodies various of the features of the invention.

In an alternate embodiment 130, as illustrated in FIG. 4, the base 62 of each of the floorboards 18 includes a single enlarged groove or recess 133 which receives both the hump 114 and the nail head 118. The enlarged groove 133 is sufficiently wide to permit reception of the hump 114 and the nail head 118, but narrow enough so that the floorboard 18 is held in place relative to the clips 22 by the hump 114 and the nail head 118.

Figure 5:
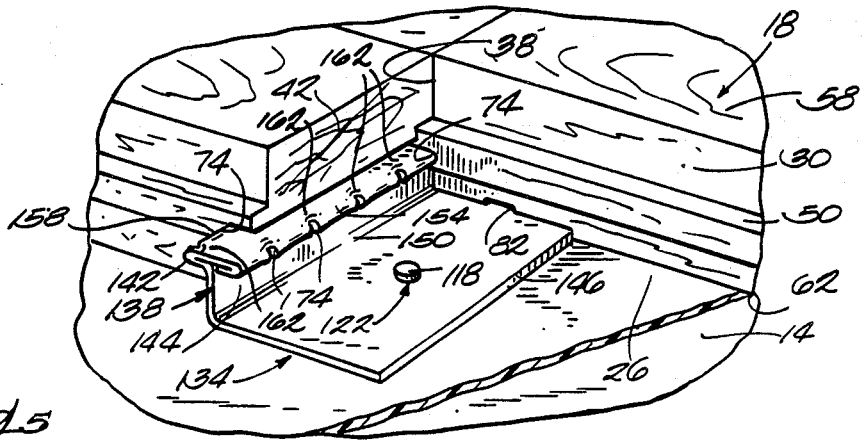
FIG. 5 is a partial perspective view of a portion of a flooring system which includes an alternate embodiment of the invention.
Figure 6:
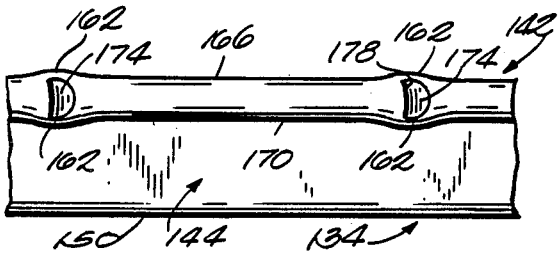
FIG. 6 is a partial side elevational view of an alternate embodiment fastener which embodies various of the features of the invention.
Figure 7:
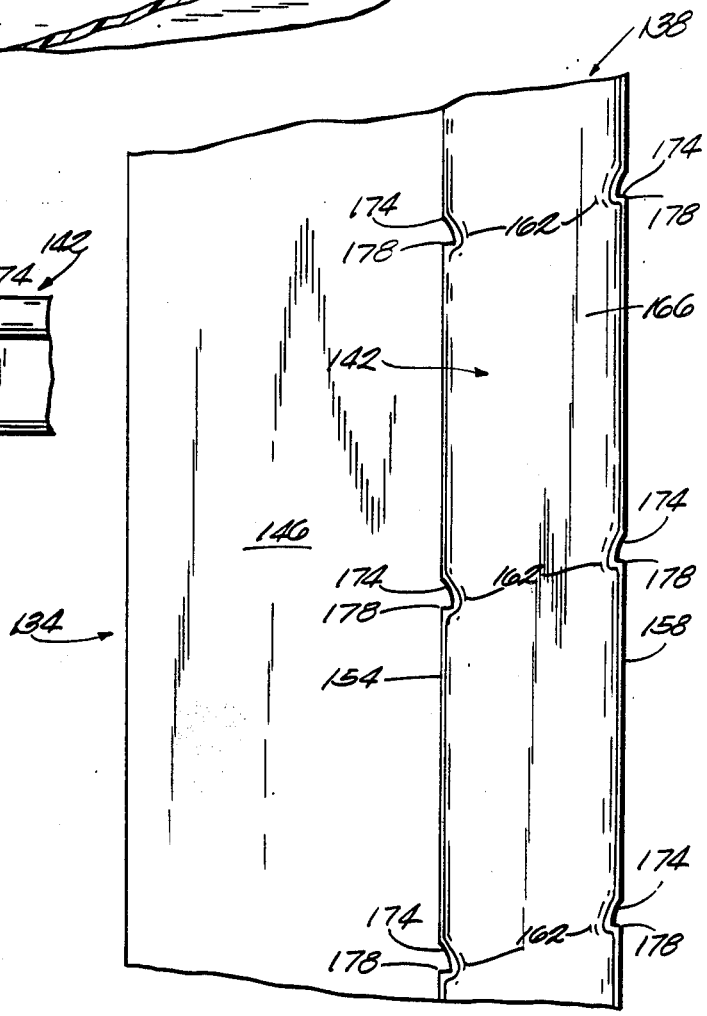
FIG. 7 is a partial top plan view of the fastener shown in FIG. 6.

An alternate embodiment of a clip for fastening the floorboards 18 to the foundation 14 is illustrated in FIGS. 5 through 7 and is generally identified by reference numeral 134. In this embodiment, the clip 134 includes an elongate member 138 of substantially T-shaped cross-section having an upper portion or cross arm 142, which is receivable in the horizontal grooves 74 formed in the ends 38 and 42 of the floorboards 18, and an elongate vertical portion or stem 144 on which the upper portion 142 is carried. To support the elongate member 138 in a substantially perpendicular, vertical orientation relative to the foundation 14, clip 134 further includes a substantially planar base 146 which is adapted to lie against foundation 14 over the vapor barrier 26 and which includes a substantially straight edge 150 which is joined to the lower edge of the stem 144 of the elongate member 138. Upper portion 142 further includes a pair of spaced, parallel, edges 154 and 158 which are individually received in grooves 74 formed in floorboard end faces 38 and 42, respectively. Clip 134 is affixed to foundation 14 by means of a plurality of nails 122 which are driven through the base portion 146 as illustrated and which are located such that their heads form projections 118 which are received in the groove 82 formed in the undersurfaces 62 of floorboards 16.

To substantially restrain the floorboards 18 against sliding movement relative to elongate member 138, at least one, and preferably a plurality of protuberances 162 are formed in the upper portion 142 of member 138 along each of the edges 154 and 158 thereof. As best seen in FIG. 6, each of the protuberances 162 extends somewhat above and below the upper and lower surfaces 166 and 170, respectively, of upper portion 142. These Protuberances engage the wood of the floorboards 18 adjacent grooves 74 to lock the floorboards into position and thereby oppose their sliding movement relative to clip 134. As further illustrated in FIGS. 5 through 7, the protuberances are formed at regular intervals along edges 154 and 158 and are preferably spaced such that one or more of the protuberances engages each of the floorboards.

To form the protuberances 162, a plurality of depressions or indentations 174 are formed in edges 154 and 158 of upper portion 142. Preferably, these depressions are formed by indenting edges 154 and 158 inwardly at selected locations so as to displace the adjacent material above and below the upper and lower surfaces 166 and 170 of the upper member 142. To aid in engaging and restraining the floorboards 18 against sliding movement relative to clip 134, the cross-sectional shape of each indentation 174 is such that a sharp edge or corner 178 is formed adjacent each indentation substantially as shown in FIG. 7.

Figure 8:
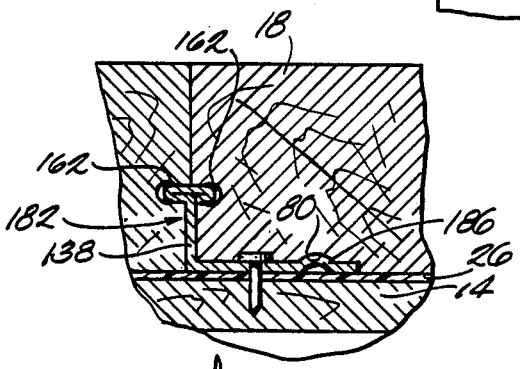
FIG. 8 is a cross-sectional view, similar to FIG. 2, of still another flooring system which embodies various of the features of the invention.

Still another embodiment of a clip 182 for fastening the floorboards 18 to the foundation 14, is illustrated in FIG. 8. Clip 182, which can otherwise be identical to clip 134, differs from clip 134 in that a hump 186 is provided in the base portion 146 as illustrated. Hump 186, which can be identical in size, shape, function and location to the hump 114 which was earlier described with regard to clip 22, cooperates with a groove 80 formed in the under surface 62 of floorboard 18, to help retain the floorboard in position relative to the clip. As further illustrated in FIG. 8, the previously described protuberances 162 are retained in edges 154 and 148 of upper portion 142 and also restrain the floorboards against sliding movement relative to the clip 182. It will be appreciated that clip 182 can also be successfully utilized with the floorboard configuration previously shown and described with reference to FIG. 4 wherein a single enlarged groove 134 was provided in the lower surface 62 of each floorboard.

Various of the features of the invention are set forth in the following claims.

I claim:

1. A flooring system comprising a foundation, a plurality of adjacent floorboards, each of said floorboards including a generally vertical side including a generally horizontal slot, and a base adjacent said foundation and including therein an opening spaced from said side, a clip including a generally horizontal upper portion received in said slot in one of said floorboards, said upper portion including a protuberance for engaging said floorboards to restrain said floorboards against sliding movement relative to said clip when said upper portion is receiving in said slot, a generally vertical portion, a lower generally horizontal base portion extending between said foundation and said base of said one floorboard, a projection extending outwardly on said base portion, and a fastener in said base portion of said clip for securing said clip to said foundation, said fastener including a head projecting above said base portion of said clip and received in said opening in said one of said floorboards.

2. A flooring system in accordance with claim 1 wherein said protuberance is formed as a result of inward displacement of said clip at a selected spaced location on said upper portion.

3. A flooring system comprising a foundation, a plurality of adjacent floorboards extending in serially adjacent parallel relationship to one another and each including a first generally vertical side including a generally horizontal slot, and a base adjacent to said foundation and including a first opening spaced from said generally vertical side of said floorboard, and a second opening spaced from said first opening and said generally vertical side of said floorboard, each of said floorboards further including a second side opposite said first side, which second side includes a generally horizontal slot, and a plurality of clips for fastening said floorboards to said foundation, each of said clips including a first generally horizontal upper portion received in said slot in said first side of one of said floorboards, a second generally horizontal upper portion received in said slot in said second side of another of said floorboards, and a generally vertical portion, at least one of upper portions including a protuberance for engaging said floorboards to restrain said floorboards against sliding movement relative to said clip when said upper portion is received in the associated one of said slots, a lower generally horizontal base portion extending between said foundation and said base of said one of said floorboards and including a first projection extending upwardly and received in said first opening in said base of said one of said floorboards, and a second projection extending upwardly and received in said second opening in said base of said one of said floorboards.

4. A flooring system in accordance with claim 3 wherein said protuberance is formed adjacent an indentation formed along said upper portion.

5. A flooring system in accordance with claim 4 wherein said indentation includes a corner for engaging said floorboards.

6. A flooring system comprising a foundation, a plurality of adjacent floorboards extending in serially adjacent parallel relationship to one another and each of said floorboards including a first generally vertical side including a generally horizontal slot, and a base adjacent to said foundation and including an opening spaced from said generally vertical side of said floorboard, said floorboard further including a second side opposite said first side, which second side includes a generally horizontal slot, and a plurality of clips for fastening said floorboards to said foundation, each of said clips including a first generally horizontal upper portion received in said slot in said first side of one of said floorboards, a second generally horizontal upper portion received in said slot in said second side of another of said floorboards, at least one of said upper portions including a plurality of protuberances for engaging said floorboards to restrain said floorboards against sliding movement relative to said clip when said upper portion is received in the associated one of said slots, a generally vertical portion, a lower generally horizontal base portion extending between said foundation and said base of said one of said floorboards and including a first projection extending upwardly and received in said opening in said base of said one of said floorboards, and a second projection extending upwardly in said base portion and spaced from said first projection and received in said opening in said base of said one of said floorboards.

7. A flooring system in accordance with claim 6 wherein said protuberances are formed adjacent respective ones of a plurality of indentations formed along said upper portion.

8. A flooring system in accordance with claim 7 wherein said indentations each include a corner for engaging said floorboards.

9. A flooring system comprising a foundation, a plurality of adjacent generally rectangular floorboards each including spaced ends having a first length and including a generaslly horizontal slot, spaced sides having a greater length than said first length, one of said sides including a groove and the other of said sides including a tongue adapted to interfit with a groove in an adjacent floorboard, and a base adjacent said foundation and including therein as first recess spaced from one of said ends and a second recess spaced from said side and spaced from said first recess, and a clip including a generally horizontal upper portion received in said slot in one of said floorboards and including a plurality of protuberances for engaging said floorboards to restrain said floorboards against sliding movement relative to said clip when said upper portion is received in said slot, a generally vertical portion, a lower generally horizontal base portion extending between said foundation and said base of said one floorboard, a projection extending outwardly on said base portion and received in said recess in said one floorboard, and a second projection extending outwardly on said base portion and spaced from said first projection and received in said second recess in said one floorboard.

10. A flooring system in accordance with claim 9 wherein said protuberances are formed adjacent respective ones of a plurality of indentations formed along said upper portion.

11. A flooring system in accordance with claim 10 wherein said indentations each include a corner for engaging said floorboards.

12. A fastener for securing a grooved floor board to a substantially planar foundation, said fastener comprising an elongate member of substantially T-shaped cross section including an upper portion extending in a plane, having a width in said plane, receivable in the groove in the floorboard, and having a edge located in said plane and including therein an indentation extending from said edge inwardly of said plane for a distance substantially less than said width, and an adjacent protuberance for engaging the floorboard along the groove to substantially restrain the floor board against sliding movement relative to said elongate member, and a base portion adjoining said elongate member opposite said upper portion for supporting said elongate member in substantially perpendicular orientation relative to the foundation.

13. A fastener in accordance with claim 12 wherein said indentation and said protuberance are formed as a result of inward displacement of said edge of said elongate member.

14. A fastener in accordance with claim 13 wherein said indentation includes a corner for engaging said floorboard.

15. A fastener for securing a grooved floorboard to a substantially planar foundation, said fastener comprising an elongate substantially planar base portion adapted to lie against the foundation and having a substantially straight edge, an elongate vertical portion formed along said edge and extending substantially perpendicularly upwardly from said base portion, and an upper portion formed on said vertical portion opposite said edge, extending in a plane, having a width in said plane receivable in the groove in the floorboard, and having an edge located in said plane and including therein an indentation extending from said edge inwardly of said plane for a distance substantially less than said width, and an adjacent protuberance for engaging the floorboard along the groove to oppose sliding movement of the floorboard relative to said fastener.

16. A fastener in accordance with claim 15 wherein said upper portion includes a plurality of said indentations and said protuberances and said indentations and said protuberances are formed as a result of localized inward displacement of said edge of said elongate member.

17. A fastener in accordance with claim 16 wherein said indentations each include a corner for engaging said floorboard.

* * * * *